US011087663B1

(12) United States Patent
Su et al.

(10) Patent No.: US 11,087,663 B1
(45) Date of Patent: Aug. 10, 2021

(54) DISPLAY DEVICE AND DRIVING METHOD THEREOF FOR REDUCING DIFFERENCE IN BRIGHTNESS BETWEEN AREAS WITH DIFFERENT WIDTHS

(71) Applicant: NOVATEK MICROELECTRONICS CORP., Hsinchu (TW)

(72) Inventors: Yu-Hung Su, Hsinchu (TW); Grace Li, Hsinchu (TW); Yen-Tao Liao, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/875,885

(22) Filed: May 15, 2020

(51) Int. Cl.
*G09G 3/20* (2006.01)

(52) U.S. Cl.
CPC ..... *G09G 3/20* (2013.01); *G09G 2310/0267* (2013.01); *G09G 2310/0272* (2013.01); *G09G 2320/0626* (2013.01)

(58) Field of Classification Search
CPC ..... G09G 3/20; G09G 2310/0267; G09G 2310/067; G09G 2300/0426
See application file for complete search history.

(56) References Cited

U.S. PATENT DOCUMENTS

2019/0108793 A1* 4/2019 Kim ..... G09G 3/3266
2019/0180694 A1* 6/2019 Lim ..... H01L 27/124
2019/0181213 A1* 6/2019 Lim ..... G09G 3/3266
2020/0202764 A1* 6/2020 Shih ..... G09G 3/20

* cited by examiner

*Primary Examiner* — Michael Pervan
(74) *Attorney, Agent, or Firm* — JCIPRNET

(57) ABSTRACT

A driving method of display device configured to be applied to a display device capable of reducing the difference in brightness between areas with different widths of a display panel includes: receiving an input signal by a processor to generate an image signal and an original data enable signal, with the image signal and the original data enable signal configured to control the display panel; and generating a gate control signal and a transmission signal by the controller based on the image signal and the original data enable signal for a scan line driver and a data line driver respectively. The gate control signal comprises a plurality of enable periods for activating the plurality of scan lines respectively, and widths of the enable periods for activating scan lines with different lengths are different. Said display device and a display driving circuit are also disclosed.

15 Claims, 3 Drawing Sheets

DISPLAY DEVICE AND DRIVING METHOD THEREOF FOR REDUCING DIFFERENCE IN BRIGHTNESS BETWEEN AREAS WITH DIFFERENT WIDTHS

BACKGROUND

1. Technical Field

The disclosure relates to a display device and a driving method of this display device, more particularly to a display device and a driving method for reducing the difference in brightness between areas with different widths of a display panel.

2. Related Art

As the need in screens of various shapes other than traditional rectangular ones increasing, problems lying in display devices with different widths show up. One of the problems is the uneven brightness due to the various widths of a screen. Specifically, an area of a display panel with a shorter width is usually brighter than another area of the display panel with a longer width. Usually, the reason why the area with the shorter width is brighter than said another area is due to the difference in numbers of sub-pixels connecting to their scan lines. A scan line of the area with the longer width must connects to sub-pixels of a number more than that of the sub-pixels connecting to a scan line of said another area with the shorter width. The different numbers of sub-pixels connecting to two scan lines having different lengths lead to different RC loadings to the two scan lines. Thus, in a frame data period for the display panel to show a frame, with said different RC loadings and identical input power to the two scan lines, the capacitors of liquid crystal (CLC) of the sub-pixels connecting to the shorter scan line can be charged faster than the CLCs of the sub-pixels connecting to the longer scan line. Thus, in the frame data period, the time for the sub-pixels connecting to the shorter scan line to display light is longer than that for the sub-pixels connecting to the longer scan line.

As a result, to the manufactures of display devices, it is an important issue about figuring out a way to solve the above problem for proving a display device having an un-rectangular screen and even display brightness.

SUMMARY

A driving method of display device configured to be applied to a display device with a plurality of scan lines having a plurality of different lengths is disclosed according to one embodiment of the present disclosure. This driving method includes: receiving an input signal by a processor to generate an image signal and an original data enable signal, with the image signal and the original data enable signal configured to control a display panel having said plurality of scan lines to display a frame; and generating a gate control signal and a transmission signal by the controller based on the image signal and the original data enable signal for controlling the display panel via a scan line driver and a data line driver respectively, wherein the gate control signal comprises a plurality of enable periods for activating the plurality of scan lines respectively, and a first width of one of the enable periods for activating a shorter scan line of the plurality of scan lines is different from a second width of another one of the enable periods for activating a longer scan line of the plurality of scan lines.

A display device capable of reducing the difference in brightness between areas with different widths of a display panel is disclosed according to another embodiment of the present disclosure. This display device includes a display panel, a data line driver, a scan line driver, a processor, and a controller. The display panel has a plurality of data lines, a plurality of scan lines, and a plurality of sub-pixels formed at intersections of the data and scan lines, with the plurality of scan lines having a plurality of different lengths. The data line driver is coupled to the plurality of data lines. The scan line driver is coupled to the plurality of scan lines. The processor is configured to receive an input signal and generates an image signal and an original data enable signal. The controller is coupled to the processor, the data line driver and the scan line driver, and generates a gate control signal and a transmission signal based on the image signal and the original data enable signal and sends the gate control signal and the transmission signal to the scan line driver and the data line driver respectively. The gate control signal comprises a plurality of enable periods for activating the plurality of scan lines respectively, and a first width of one of the enable periods for activating a shorter scan line of the plurality of scan lines is different from a second width of another one of the enable periods for activating a longer scan line of the plurality of scan lines.

A display driving circuit configured to reduce the difference in brightness between areas with different widths of a display panel is disclosed according to further another embodiment of the present disclosure. This display driving circuit includes a data line driver, a scan line driver, a processor, and a controller, and is for controlling the display panel having a plurality of data lines, a plurality of scan lines, and a plurality of sub-pixels formed at intersections of the data and scan lines, with the plurality of scan lines having a plurality of different lengths. The data line driver is configured to be coupled to the plurality of data lines. The scan line driver is configured to be coupled to the plurality of scan lines. The processor is configured to receive an input signal and generates an image signal and an original data enable signal. The controller is coupled to the processor, the data line driver and the scan line driver, and generates a gate control signal and a transmission signal based on the image signal and the original data enable signal and sends the gate control signal and the transmission signal to the scan line driver and the data line driver respectively. The gate control signal comprises a plurality of enable periods for activating the plurality of scan lines respectively, and a first width of one of the enable periods for activating a shorter scan line of the plurality of scan lines is different from a second width of another one of the enable periods for activating a longer scan line of the plurality of scan lines.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
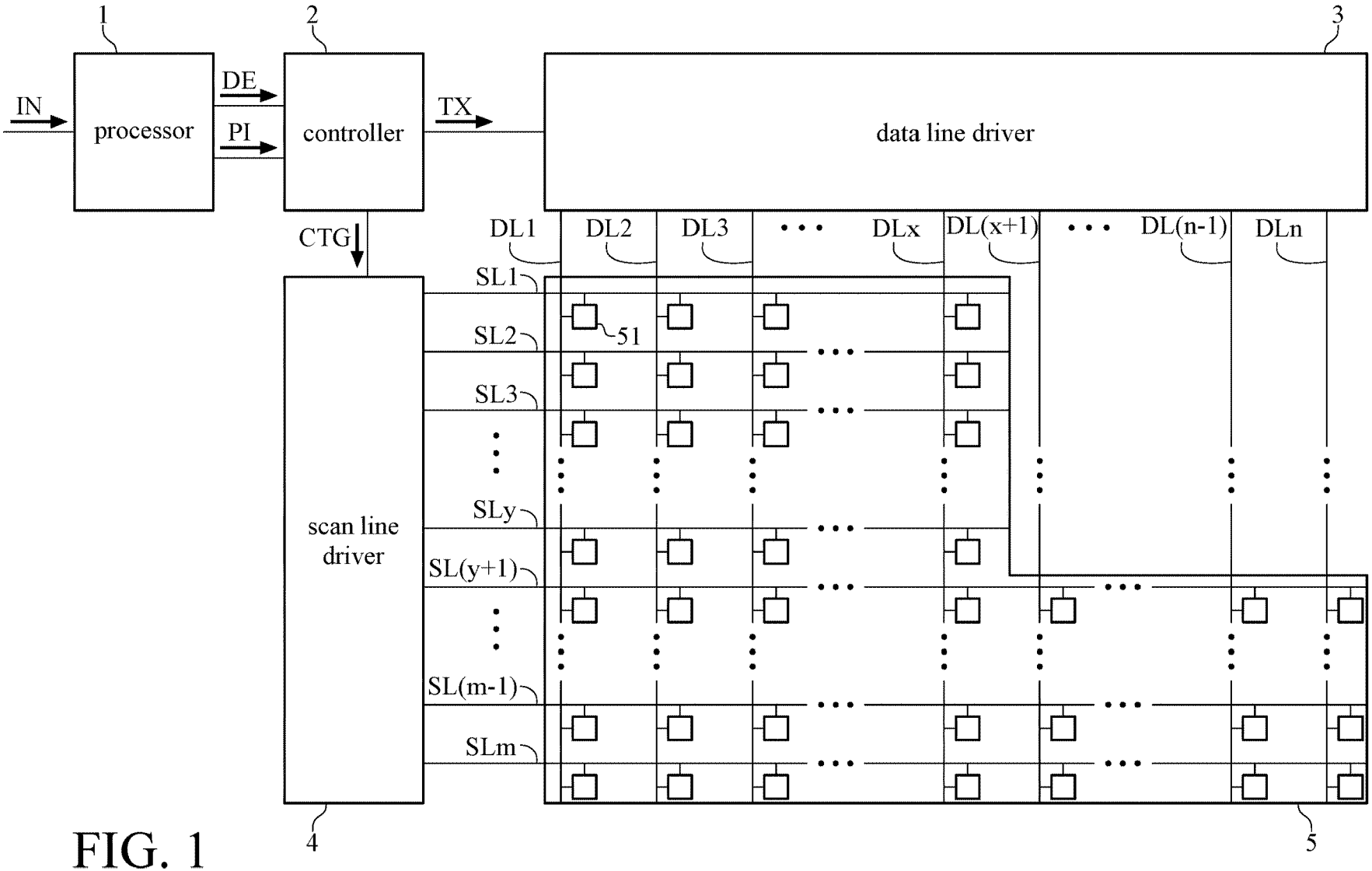
FIG. 1 is a block diagram illustrating a display device capable of reducing difference in brightness between areas with different widths according to an embodiment of the present disclosure.

Please refer to FIG. 1, a block diagram illustrating a display device capable of reducing difference in brightness between areas with different widths according to an embodiment of the present disclosure. In the display device of this embodiment, there are a processor 1, a controller 2, a data line driver 3, a scan line driver 4 and a display panel 5. The processor 1 receives an input signal IN and controls the data line driver 3 and the scan line driver 4 via the controller 2, so that the display panel 5 with scan lines SL1-SLm having at least two different lengths can show frames contained in the input signal IN. In the following disclosure, the length of a scan line directly corresponds to the number of sub-pixels connecting to this scan line. That is, the difference between two lengths of any two scan lines means that the numbers of sub-pixels connecting to these two scan lines are different. Furthermore, a display driving circuit of the display device is further defined, includes the processor 1, the controller 2, the data line driver 3, and the scan line driver 4, and is configured to control the display panel 5.

Specifically, the processor 1, which may be a processing unit used in a common display device, receives the input signal IN to generate an image signal PI and an original data enable signal DE based on the input signal IN. The image signal PI and the original data enable signal DE are configured to control the display panel 5 to display frames. The image signal PI has a plurality of frame data periods and a plurality of vertical blank intervals interlaced with each other; namely, the frame data periods and the vertical blank intervals are arranged alternately in time. In each of the frame data periods, a frame data is included for the display panel 5 to show one of the frames corresponding to the frame data. In each of the vertical blank interval, there will be no content to be shown by the display panel 5, and thus signals such as test signals, time codes, closed captioning, teletext, etc. can be sent during this time period. The data enable signal DE has a plurality of effective data periods while each effective data period includes a plurality of enable pulses, and pulse widths of these enable pulses are the same. The effective data periods are corresponding to the frame data periods of the image signal PI respectively.

Figure 2:
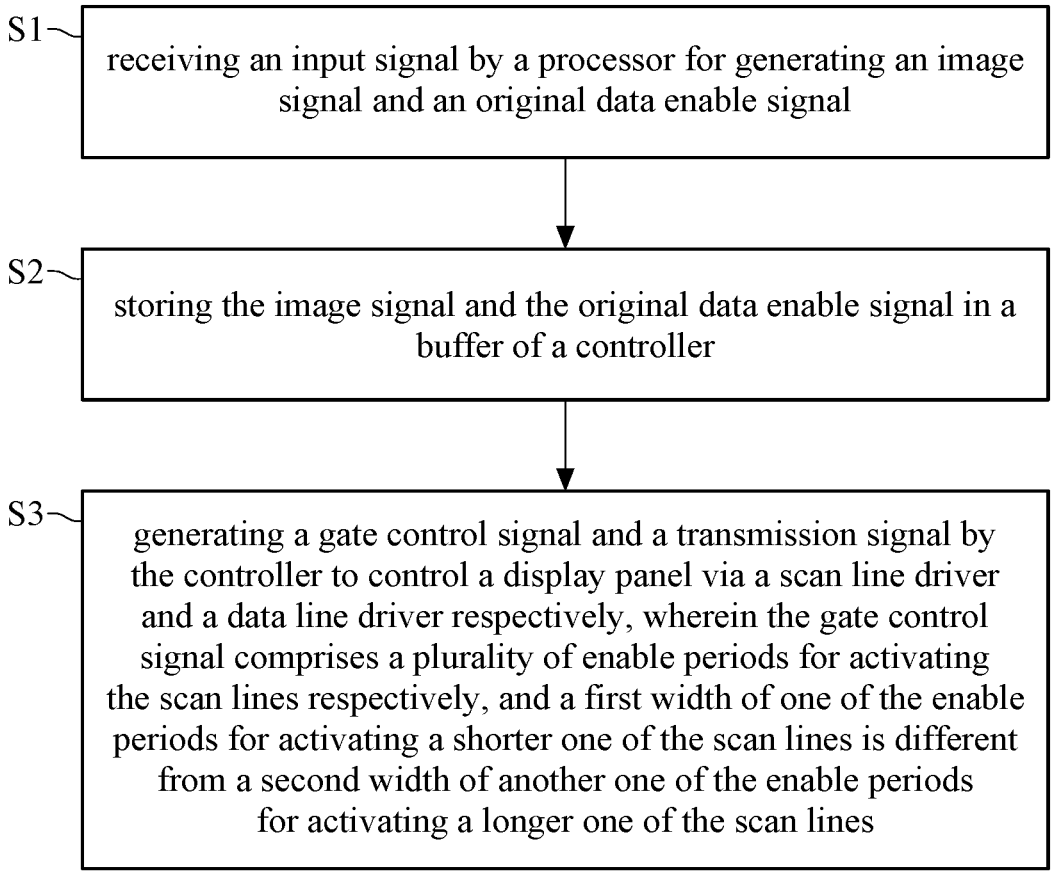
FIG. 2 is a flow chart illustrating the driving method for reducing difference in brightness between areas with different widths according to an embodiment of the present disclosure.

The controller 2 shown in FIG. 2 couples to the processor 1 and receives the image signal PI and the original data enable signal DE generated thereby, and said controller 2 may be implemented by a timing controller of a common display device. The controller 2 stores the image signal PI and the original data enable signal DE in a buffer to further process these two signals PI and DE. Based on the lengths of the scan lines SL1-SLm of the display panel 5, the controller 2 adjusts the original data enable signal DE into a processed data enable signal PDE. In comparison to the original data enable signal DE, although there is a plurality of effective data periods having enable pulses in the processed data enable signal PDE still, the pulse widths of the enable pulses in different effective data periods for activating scan lines SL1-SLm with different lengths are different in the processed data enable signal PDE. Preferably, a length in time of each effective data period of the original data enable signal DE is equal to that of the processed data enable signal PDE. Once obtained the processed data enable signal PDE, the controller 2 generates a transmission signal TX based on the processed data enable signal PDE and the image signal PI for controlling the data line driver 3, as well as a gate control signal CTG based on the processed data enable signal PDE for controlling the scan line driver 4. Specifically, the gate control signal CTG includes a plurality of enable periods corresponding to the plurality of enable pulses of the processed data enable signal PDE. Some details about the processed data enable signal PDE and the gate control signal CTG will be illustrated further in the later contents.

The data line driver 3 couples to the controller 2 and receives the transmission signal TX. Thus, according to the transmission signal TX, the data line driver 3 generates a plurality of series of data pulses in each of the frame data periods. Each series of data pulses corresponds to the data of a respective column of a frame to be shown in a frame data period. Specifically, since the transmission signal TX is generated based on the processed data enable signal PDE, in different series of data pulses corresponding to columns with different lengths, the pulse widths of data pulses are different. The data line driver 3 may include more than one source driving IC while the number of the source driving ICs depends on the horizontal size of the display panel 5 and the output pins of each source driving IC.

The scan line driver 4 also couples to the controller 2, and the scan line driver 4 receives the control signal CTG from the controller 2. According to the control signal CTG, the scan line driver 4 generates a set of active voltages for each frame data period and a cutoff voltage for each vertical blank interval, and the high logic periods of the active voltages are corresponding to the enable periods of the gate control signal CTG and the scan periods of the processed data enable signal PDE. Similarly, the scan line driver 4 may include more than one gate driving IC while the number of the gate driving ICs depends on the vertical size of the display panel 5 and the output pins of each gate driving IC.

The display panel 5 includes a plurality of data lines DL1-DLn, the plurality of scan lines SL1-SLm with different lengths, and a plurality of sub-pixels 51. The plurality of data lines DL1-DLn connects to the data line driver 3 and receives the plurality of series of data pulses. The plurality of scan lines SL1-SLm connects to the scan line driver 4 and receives the set of active voltages and the cutoff voltage. The plurality of sub-pixels 51 is formed at intersections of the data lines DL1-DLn and the scan lines SL1-SLm while each of the sub-pixels 51 connects to a respective one of the data lines DL1-DLn and a respective one of the scan lines SL1-SLm. In this embodiment, the display panel 5 is adapted to form a L-shaped screen, and thus the scan lines SL1-SLm are divided into two groups. The scan line SL1 through the scan line Sly are shorter scan lines having a shorter length, and the scan line SL(y+1) through the scan line SLm are longer scan lines having a longer length. Furthermore, in the display panel 5 of this embodiment, the data lines DL1-DLn are also divided into two groups. The data line DL1 through the data line DLx extend across the scan lines SL1-SLm while the data line DL(x+1) through the data line DLn extend across the scan lines SL(y+1)-SLm. Therefore, in this embodiment, the number of the sub-pixels 51 connecting to any one of the scan lines SL1-Sly is "x", and the number of the sub-pixels 51 connecting to any one of scan lines SL(y+1)-SLm is "n" less than "x". Although the above-disclosed arrangement of the scan lines SL1-SLm is configured for a L-shaped screen, the display panel 5 can be changed depending upon the screen shape of the display device. In operation, when the image signal PI sent to the controller 2 is during the frame data period, the plurality of data lines DL1-DLn receives the plurality of series of data pulses sequentially, and the plurality of scan lines SL1-SLm receives the set of active voltages, so that each series of data pulses corresponding to the data of a respective column of the frame is installed into the sub-pixels 51 connecting to a respective one of the scan lines SL1-SLm, while said respective one of the scan lines SL1-SLm receives the active voltage and others receive the cutoff voltage. Namely, the enable periods of the gate control signal CTG based on which the controller 2 generates the set of active voltages are configured to activate the scan lines SL1-SLm respectively.

Figure 3:
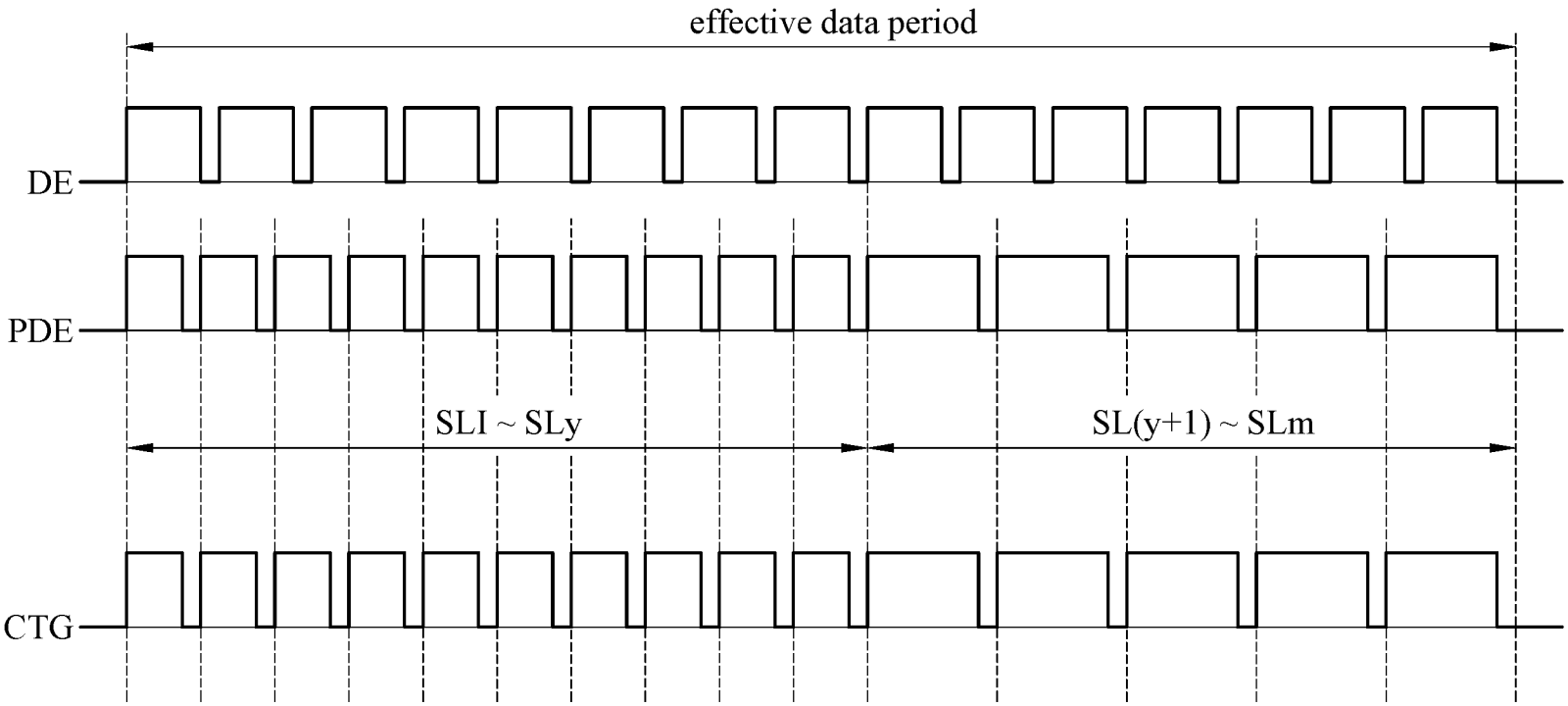
FIG. 3 is a voltage chart illustrating the signals transmitted in the display device according to the embodiment of the present disclosure.

Specifically, please also refer to FIG. 2 in addition to FIG. 1, which is a flow chart illustrating the driving method for reducing difference in brightness between areas with different widths according to an embodiment of the present disclosure. In step S1, the processor 1 receives the input signal IN and generates the image signal PI and the original data enable signal DE based on the input signal IN. In step S2, the controller 2 receives the image signal IP and the original data enable signal DE and stores these signals IP and DE in the buffer. In step 3, the controller 2 generates the gate control signal CTG and the transmission signal TX based on the image signal IP and the original data enable signal DE so as to control the display panel 5 via the data line driver 3 and the scan line driver 4. Please further refer to FIG. 3 in addition to FIGS. 1 and 2, which is a voltage chart briefly illustrating the signals transmitted in the display device according to the embodiment of the present disclosure. In the gate control signal CTG generated by the controller 2 according to the processed data enable signal PDE, a first width of one of the enable periods for activating one of the shorter scan lines SL1-Sly is different from a second width of another one of the enable periods for activating one of the longer scan lines SL(y+1)-SLm. Specifically, the longer an activated scan line is, the longer the widths of the respective enable periods are. Namely, a ratio of the first width to the second width is in positive correlation to another ratio of the length of each shorter scan line SL1-Sly to the length of each longer scan line SL(y+1)-SLm.

Furthermore, please refer to FIGS. 1 and 3 again. Specifically, and preferably, the controller 2 has a set of adjusting values corresponding to the scan lines SL1-SLm; preferably, the set of adjusting values is in positive correlation to the lengths of the scan lines SL1-SLm. In other words, one of the adjusting values corresponding to the shorter scan lines SL1-SLy is smaller than another one of the adjusting values corresponding to the longer scan lines SL(y+1)-SLm. Based on the set of adjusting values, the controller 2 may adjust at least a part of the pulse widths of the original data enable signal DE to obtain the processed data enable signal PDE, such as by multiplying each of the pulse width of the original data enable signal DE by a respective one of the adjusting values. For example, the adjusting value corresponding to the shorter scan lines SL1-Sly is 0.8 while the adjusting value corresponding to the longer data lines SL(y+1)-SLm is 1.6. Finally, as what has been illustrated above, the enable periods of the gate control signal CTG generated according to the processed data enable signal PDE, based on which the scan line driver 4 generates the set of active voltages and then activates the scan lines SL1-SLm, may have different widths to supply different quantities of power to the scan lines SL1-SLm. This set of adjusting values can be previously determined by designers according to the numbers of sub-pixels 51 connecting to the scan lines SL1-SLm one by one. However, it can also be set based on a function expressing a relationship between the number of sub-pixels connecting to a scan line and the adjusting value.

In view of the foregoing descriptions, by implementing the driving method disclosed in the present disclosure, the uneven brightness due to various widths of a display panel, which result in different lengths of scan lines as well as different numbers of sub-pixels connecting thereto respectively, the quantities of power provided by a scan line driver to the scan lines are various based on the lengths of the scan lines. Therefore, even though the RC loadings of scan lines with different lengths are different, the different quantities of power can adaptively charge the CLCs of the sub-pixels, so that the CLCs of sub-pixels connecting to a shorter scan line may be charged faster for a shorter time period, and the CLCs of sub-pixels connecting to a longer scan line may be charged slower for a longer time period. Accordingly, the light displayed by the CLCs of the sub-pixels connecting to either the shorter scan line or the longer scan line seems even to the user of this display device.

What is claimed is:

1. A driving method of display device, configured to be applied to a display device with a plurality of scan lines having a plurality of different lengths, with the driving method comprising:

receiving an input signal by a processor to generate an image signal and an original data enable signal, with the image signal and the original data enable signal configured to control a display panel having said plurality of scan lines to display a frame; and generating a gate control signal and a transmission signal by a controller based on the image signal and the original data enable signal for controlling the display panel via a scan line driver and a data line driver respectively, wherein the gate control signal comprises a plurality of enable periods for activating the plurality of scan lines respectively, and a first width of one of the enable periods for activating a shorter scan line of the plurality of scan lines is different from a second width of another one of the enable periods for activating a longer scan line of the plurality of scan lines.

2. The driving method of display device according to claim 1 further comprising storing the image signal and the original data enable signal in a buffer of the controller before generating the gate control signal and the transmission signal by the controller.

3. The driving method of display device according to claim 1, wherein a first ratio of the first width to the second width is in positive correlation to a second ratio of a length of the shorter scan line to a length of the longer scan line.

4. The driving method of display device according to claim 1, wherein generating the gate control signal and the transmission signal by the controller based on the image signal and the original data comprises:

generating a processed data enable signal by the controller according to the original data enable signal and the plurality of scan lines, with the processed data enable signal having a plurality of enable pulses with different pulse widths;

generating the gate control signal by the controller based on the processed data enable signal, wherein the plurality of enable periods of the gate control signal is corresponding to the plurality of enable pulses of the processed data enable signal; and generating the transmission signal by the controller based on the processed data enable signal and the image signal.

5. The driving method of display device according to claim 4, wherein generating the processed data enable signal by the controller according to the original data enable signal and the plurality of scan lines:

generating a set of adjusting values corresponding to the plurality of scan lines; and adjusting pulse widths of at least a part of the enable pulses of the original data enable signal based on the set of adjusting values to obtain the processed data enable signal.

6. A display device, comprising:

a display panel having a plurality of data lines, a plurality of scan lines, and a plurality of sub-pixels formed at intersections of the data and scan lines, with the plurality of scan lines having a plurality of different lengths;

a data line driver coupled to the plurality of data lines;

a scan line driver coupled to the plurality of scan lines;

a processor configured to receive an input signal and generating an image signal and an original data enable signal; and a controller coupled to the processor, the data line driver and the scan line driver, wherein the controller generates a gate control signal and a transmission signal based on the image signal and the original data enable signal and sends the gate control signal and the transmission signal to the scan line driver and the data line driver respectively, wherein the gate control signal comprises a plurality of enable periods for activating the plurality of scan lines respectively, and a first width of one of the enable periods for activating a shorter scan line of the plurality of scan lines is different from a second width of another one of the enable periods for activating a longer scan line of the plurality of scan lines.

7. The display device according to claim 6, wherein the controller stores the image signal and the original data enable signal in a buffer thereof.

8. The display device according to claim 6, wherein a first ratio of the first width to the second width is in positive correlation to a second ratio of a length of the shorter scan line to a length of the longer scan line.

9. The display device according to claim 6, wherein the controller generates a processed data enable signal according to the original data enable signal and the plurality of scan lines, generates the gate control signal based on the processed data enable signal, and generates the transmission signal based on the processed data enable signal and the image signal, wherein the processed data enable signal has a plurality of enable pulses with different widths, and the plurality of enable periods of the gate control signal is corresponding to the plurality of enable pulses of the processed data enable signal.

10. The display device according to claim 9, wherein the controller has a set of adjusting values corresponding to the plurality of scan lines and adjusts pulse widths of at least a part of the enable pulses of the original data enable signal based on the set of adjusting values to obtain the processed data enable signal.

11. A display driving circuit, configured to control a display panel having a plurality of data lines, a plurality of scan lines, and a plurality of sub-pixels formed at intersections of the data and scan lines, with the plurality of scan lines having a plurality of different lengths, and with the display driving circuit comprising:

a data line driver configured to be coupled to the plurality of data lines;

a scan line driver configured to be coupled to the plurality of scan lines;

a processor configured to receive an input signal and generating an image signal and an original data enable signal; and a controller coupled to the processor, the data line driver and the scan line driver, wherein the controller generates a gate control signal and a transmission signal based on the image signal and the original data enable signal and sends the gate control signal and the transmission signal to the scan line driver and the data line driver respectively, wherein the gate control signal comprises a plurality of enable periods for activating the plurality of scan lines respectively, and a first width of one of the enable periods for activating a shorter scan line of the plurality of scan lines is different from a second width of another one of the enable periods for activating a longer scan line of the plurality of scan lines.

12. The display driving circuit according to claim 11, wherein the controller stores the image signal and the original data enable signal in a buffer thereof.

13. The display driving circuit according to claim 11, wherein a first ratio of the first width to the second width is in positive correlation to a second ratio of a length of the shorter scan line to a length of the longer scan line.

14. The display driving circuit according to claim 11, wherein the controller generates a processed data enable signal according to the original data enable signal and the plurality of scan lines, generates the gate control signal based on the processed data enable signal, and generates the transmission signal based on the processed data enable signal and the image signal, wherein the processed data enable signal has a plurality of enable pulses with different widths, and the plurality of enable periods of the gate control signal is corresponding to the plurality of enable pulses of the processed data enable signal.

15. The display driving circuit according to claim 14, wherein the controller has a set of adjusting values corresponding to the plurality of scan lines and adjusts pulse widths of at least a part of the enable pulses of the original data enable signal based on the set of adjusting values to obtain the processed data enable signal.

* * * * *